US009548573B2

(12) United States Patent
Yu

(10) Patent No.: US 9,548,573 B2
(45) Date of Patent: Jan. 17, 2017

(54) HIGH-SPEED-TRANSMISSION CONNECTION DEVICE HAVING A METAL PROTRUSION ELECTRICALLY CONNECTED TO A CONNECTOR

(71) Applicant: MediaTek Inc., Hsin-Chu (TW)

(72) Inventor: Long-Kun Yu, New Taipei (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 14/657,041

(22) Filed: Mar. 13, 2015

(65) Prior Publication Data

US 2015/0295360 A1 Oct. 15, 2015

(30) Foreign Application Priority Data

Apr. 10, 2014 (TW) ..... 103113181 A

(51) Int. Cl.
*H01R 13/648* (2006.01)
*H01R 13/6583* (2011.01)
*H01R 13/6584* (2011.01)

(52) U.S. Cl.
CPC ..... *H01R 13/6583* (2013.01); *H01R 13/6584* (2013.01)

(58) Field of Classification Search
CPC ..... H01R 13/658; H01R 13/6584; H01R 13/6485; H01R 13/648; H01R 13/6585
USPC ..... 439/607.01–607.54
See application file for complete search history.

(56) References Cited

U.S. PATENT DOCUMENTS 4,426,127 A * 1/1984 Kubota ..... H01R 24/40 439/578
4,509,814 A * 4/1985 Mattingly, Jr. .... H01R 13/5219 439/271
4,674,807 A * 6/1987 Boteler ..... H01R 13/652 439/106
4,941,850 A * 7/1990 Ankers ..... H01R 9/0518 29/858
4,985,002 A * 1/1991 Maisch ..... H01R 13/65802 439/607.01
6,305,961 B1 10/2001 Szilagyi et al.
7,214,097 B1 * 5/2007 Hsu ..... H01R 13/65802 439/607.47
7,341,487 B2 3/2008 Wu
7,618,290 B2 * 11/2009 Van Gennip ..... H05K 9/005 439/577

(Continued)

FOREIGN PATENT DOCUMENTS

CN 1333587 1/2002
CN 2629278 7/2004

(Continued)

*Primary Examiner* — Chandrika Prasad
(74) *Attorney, Agent, or Firm* — McClure, Qualey & Rodack, LLP

(57) ABSTRACT

A high-speed-transmission connection device includes a male connector, a cable, and a metal protrusion structure. The cable is connected to the male connector. The metal protrusion structure is formed on an outer surface of the male connector. When the male connector is connected to a female connector, the metal protrusion structure is in close contact with the inner surface of the female connector. The metal protrusion structure fills a gap between the male connector and the female connector, and prevents electromagnetic waves from leaking outwardly from the gap.

20 Claims, 7 Drawing Sheets

(56) References Cited

U.S. PATENT DOCUMENTS

| | | | | |
|---|---|---|---|---|
| 8,294,043 | B2 * | 10/2012 | Munoz | H01R 13/6595<br>174/359 |
| 2011/0300749 | A1 * | 12/2011 | Sytsma | H01R 13/65802<br>439/607.01 |
| 2012/0202378 | A1 * | 8/2012 | Krenceski | H01R 9/0524<br>439/578 |

FOREIGN PATENT DOCUMENTS

| | | |
|---|---|---|
| CN | 202888527 | 4/2013 |
| TW | M1324882 | 1/2008 |
| TW | M396506 U1 | 1/2011 |
| TW | M1396506 U1 | 1/2011 |

* cited by examiner

HIGH-SPEED-TRANSMISSION CONNECTION DEVICE HAVING A METAL PROTRUSION ELECTRICALLY CONNECTED TO A CONNECTOR

CROSS REFERENCE TO RELATED APPLICATIONS

This Application claims priority of Taiwan Patent Application No. 103113181 filed on Apr. 10, 2014, the entirety of which is incorporated by reference herein.

BACKGROUND OF THE INVENTION

Field of the Invention

The disclosure generally relates to a high-speed-transmission connection device, and more particularly, to a high-speed-transmission connection device for reducing EMI (Electromagnetic Interference).

Description of the Related Art

With the advancement of mobile communication technology, mobile devices such as portable computers, mobile phones, multimedia players, and other hybrid functional portable electronic devices have become more common. To satisfy the demands of users, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and those using frequency bands of 2.4 GHz, 5.2 GHz, and 5.8 GHz.

Antennas are indispensable elements for mobile devices supporting wireless communications. It should be noted that antennas tend to be affected by surrounding electromagnetic noise. For example, when data transmission interfaces of mobile devices are connected to other external devices, the electromagnetic waves leaking from the data transmission interfaces may negatively affect the normal operations of antennas. Such interference becomes serious if the frequency of transmission signals is increased. Since the electromagnetic noise cannot be removed completely by filters, it may significantly degrade the communication quality of mobile devices.

BRIEF SUMMARY OF THE INVENTION

To solve the problem of the prior art, in one preferred embodiment, the disclosure is directed to a high-speed-transmission connection device including a male connector, a cable, and a metal protrusion structure. The cable is connected to the male connector. The metal protrusion structure is formed on an outer surface of the male connector.

In some embodiments, the high-speed-transmission connection device further includes a cladding layer. The cladding layer covers the male connector and the cable. The cladding layer is made of a nonconductive material. In some embodiments, the metal protrusion structure is substantially circularly-arc-shaped. In some embodiments, when the male connector is connected to a female connector, the metal protrusion structure is in close contact with an inner surface of the female connector. In some embodiments, the metal protrusion structure fills a gap between the male connector and the female connector, and prevents electromagnetic waves from leaking outwardly from the gap. In some embodiments, the metal protrusion structure includes a loop portion, and the loop portion surrounds the outer surface of the male connector. In some embodiments, the metal protrusion structure includes a first loop portion and a second loop portion, the first loop portion is separate from the second loop portion, and both the first loop portion and the second loop portion surround the outer surface of the male connector. In some embodiments, the metal protrusion structure includes a plurality of protrusion portions, and the protrusion portions are separate from each other and interleaved with each other on the outer surface of the male connector. In some embodiments, the high-speed-transmission connection device is applied to a USB (Universal Serial Bus) interface, an HDMI (High-Definition Multimedia Interface) interface, or a SATA (Serial Advanced Technology Attachment) interface.

In another preferred embodiment, the disclosure is directed to a high-speed-transmission connection device including a female connector and a metal protrusion structure. The metal protrusion structure is formed on an inner surface of the female connector.

In some embodiments, the metal protrusion structure is substantially circularly-arc-shaped. In some embodiments, when the female connector is connected to a male connector, the metal protrusion structure is in close contact with an outer surface of the male connector. In some embodiments, the metal protrusion structure fills a gap between the male connector and the female connector, and prevents electromagnetic waves from leaking outwardly from the gap. In some embodiments, the metal protrusion structure includes a loop portion, and the loop portion surrounds the inner surface of the female connector. In some embodiments, the metal protrusion structure includes a first loop portion and a second loop portion, the first loop portion is separate from the second loop portion, and both the first loop portion and the second loop portion surround the inner surface of the female connector. In some embodiments, the metal protrusion structure includes a plurality of protrusion portions, and the protrusion portions are separate from each other and interleaved with each other on the inner surface of the female connector. In some embodiments, the high-speed-transmission connection device is applied to a USB (Universal Serial Bus) interface, an HDMI (High-Definition Multimedia Interface) interface, or a SATA (Serial Advanced Technology Attachment) interface. In some embodiments, the high-speed-transmission connection device further includes a metal fastening element. The metal fastening element is connected to a back side of the female connector. The metal fastening element is substantially inverted-U-shaped. In some embodiments, the metal fastening element is soldered to the female connector through an SMT (Surface Mount Technology) process. In some embodiments, the high-speed-transmission connection device further includes a metal back cover. The metal back cover is engaged to the metal fastening element after the SMT process has been performed completely.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention will be described in detail as follows.

Figure 1A:
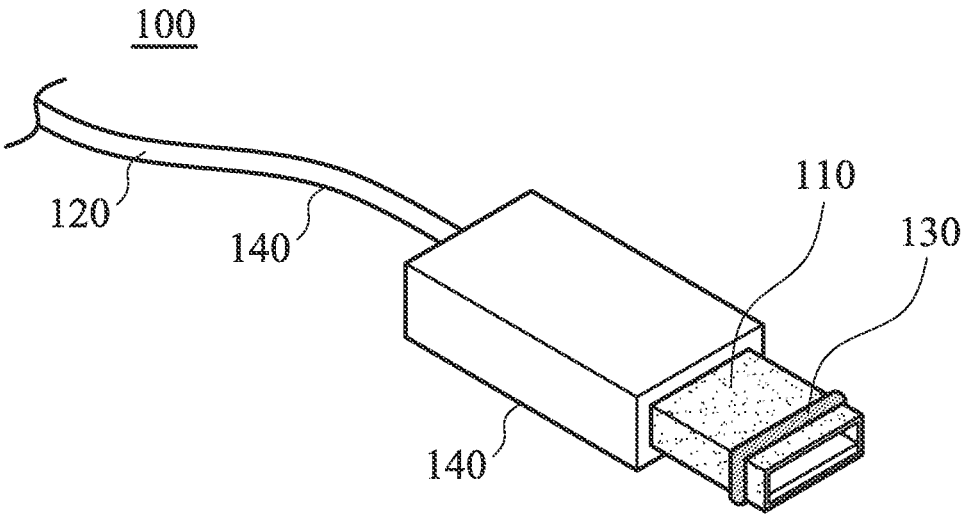
FIG. 1A is a perspective view of a high-speed-transmission connection device according to an embodiment of the invention.

FIG. 1A is a perspective view of a high-speed-transmission connection device 100 according to an embodiment of the invention. The high-speed-transmission connection device 100 may be applied to a variety of high-speed-transmission interfaces, such as a USB (Universal Serial Bus) interface, an HDMI (High-Definition Multimedia Interface) interface, or a SATA (Serial Advanced Technology Attachment) interface, but the invention is not limited to the above.

As shown in FIG. 1A, the high-speed-transmission connection device 100 includes a male connector 110, a cable 120, and a metal protrusion structure 130. The male connector 110 may be made of a conductive material, such as a metal material. The shape and type of the male connector 110 are not limited in the invention. The cable 120 is connected to the male connector 110. The metal protrusion structure 130 is formed on an outer surface of the male connector 110 (i.e., the metal protrusion structure 130 protrudes outwardly). In some embodiments, the high-speed-transmission connection device 100 further includes a cladding layer 140. The cladding layer 140 may cover the male connector 110 and the cable 120, but may not cover the metal protrusion structure 130. The cladding layer 140 may be made of a nonconductive material, such as a plastic material, and it can be used to prevent the male connector 110 and the cable 120 from being oxidized.

Figure 1B:
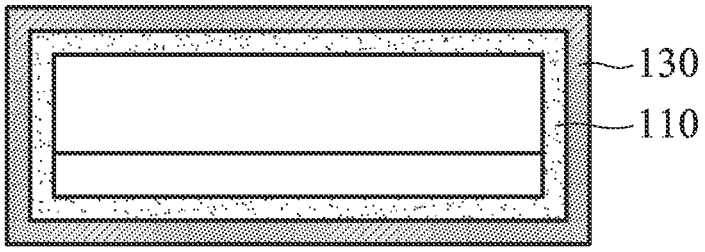
FIG. 1B is a sectional view of a high-speed-transmission connection device according to an embodiment of the invention.

FIG. 1B is a sectional view of the high-speed-transmission connection device 100 according to an embodiment of the invention. Please refer to FIG. 1A and FIG. 1B together. The metal protrusion structure 130, formed on the male connector 110, may be substantially circularly-arc-shaped and have metal flexibility. In the embodiment of FIG. 1A and FIG. 1B, the metal protrusion structure 130 includes a loop portion, and the loop portion completely surrounds the outer surface of the male connector 110. In alternative embodiments, the metal protrusion structure 130 may have a different shape, such as a cubical shape or a triangular prism shape. In alternative embodiments, the metal protrusion structure 130 may be formed on only a portion of the male connector 110 (e.g., one side of the outer surface of the male connector 110), and may not surround the entire outer surface of the male connector 110. The usage of the metal protrusion structure 130 will be described in detail in the following embodiments.

Figure 2A:
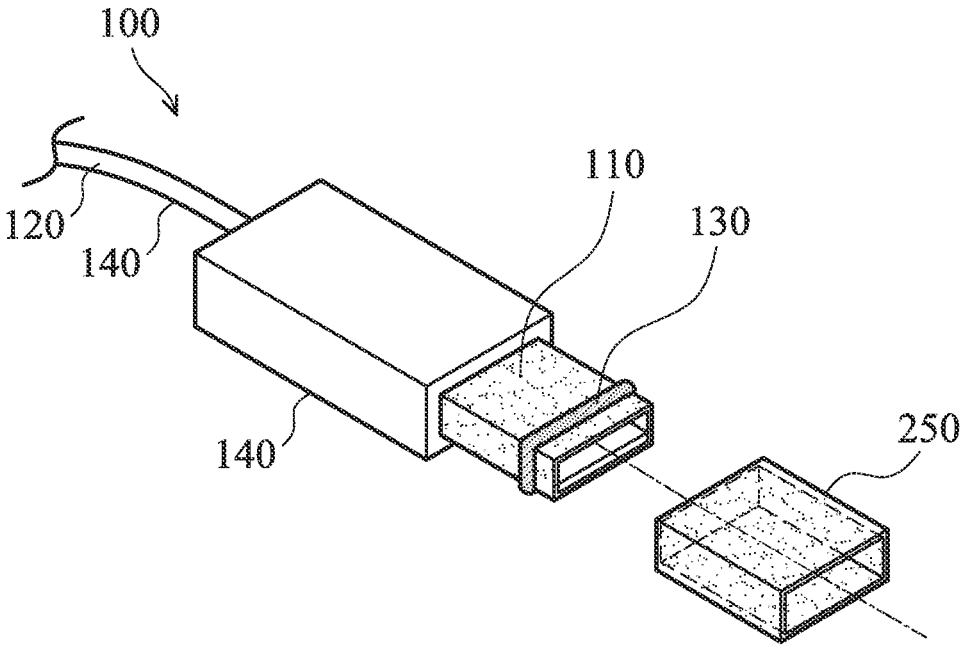
FIG. 2A is a perspective view of a high-speed-transmission connection device and a female connector according to an embodiment of the invention.
Figure 2B:
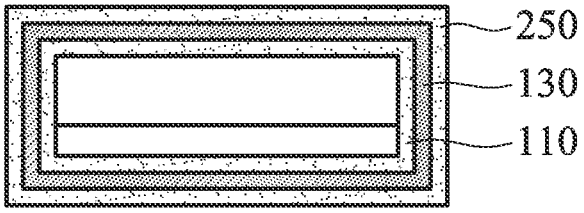
FIG. 2B is a sectional view of a high-speed-transmission connection device and a female connector according to an embodiment of the invention.

FIG. 2A is a perspective view of the high-speed-transmission connection device 100 and a female connector 250 according to an embodiment of the invention. FIG. 2B is a sectional view of the high-speed-transmission connection device 100 and the female connector 250 according to an embodiment of the invention. Please refer to FIG. 2A and FIG. 2B together. It should be understood that the female connector 250 may be any general connector corresponding to the male connector 110. For example, if the male connector 110 is a USB male connector, the female connector 250 may be a USB female connector. When the male connector 110 of the high-speed-transmission connection device 100 is connected to the female connector 250, the metal protrusion structure 130, formed on the outer surface of the male connector 110, is in close contact with the inner surface of the female connector 250. More specifically, since the metal protrusion structure 130 has metal flexibility, it may be slightly compressed and tend to engage with the inner surface of the female connector 250. The metal protrusion structure 130 can fill a gap between the male connector 110 and the female connector 250, and prevent electromagnetic waves from leaking outwardly from the gap. With the design of the invention, even if there are high-frequency signal delivered in transmission interfaces, the induced electromagnetic waves cannot radiate outwardly from the gap between the male connector 110 and the female connector 250, thereby effectively reducing the EMI (Electromagnetic Interference) in devices. Accordingly, the invention can solve the problem of electromagnetic noise from transmission interfaces affecting conventional antennas, and it is suitable for application in a variety of electronic devices supporting wireless communication, such as smartphones, tablet computers, or notebook computers, so as to enhance the communication quality of electronic devices.

Figure 3:
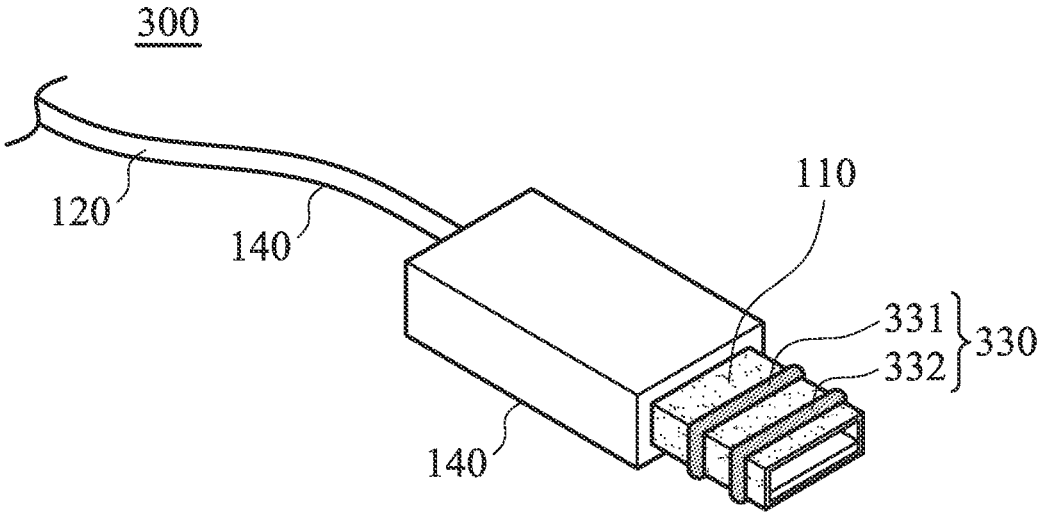
FIG. 3 is a perspective view of a high-speed-transmission connection device according to an embodiment of the invention.

FIG. 3 is a perspective view of a high-speed-transmission connection device 300 according to an embodiment of the invention. FIG. 3 is similar to FIG. 1A. In the embodiment of FIG. 3, a metal protrusion structure 330 of the high-speed-transmission connection device 300 includes a first loop portion 331 and a second loop portion 332. The first loop portion 331 is separate from and substantially parallel to the second loop portion 332. Both the first loop portion 331 and the second loop portion 332 surround the outer surface of the male connector 110. In alternative embodiments, the metal protrusion structure 330 may include three, four, five, or more separate and parallel loop portions. With such a design of multi-protrusion structure, the high-speed-transmission connection device 300 can further reduce the electromagnetic wave leakage and EMI. Other features of the embodiment of FIG. 3 are similar to those of the embodiment of FIG. 1A. Accordingly, the two embodiments can achieve similar levels of performance.

Figure 4:
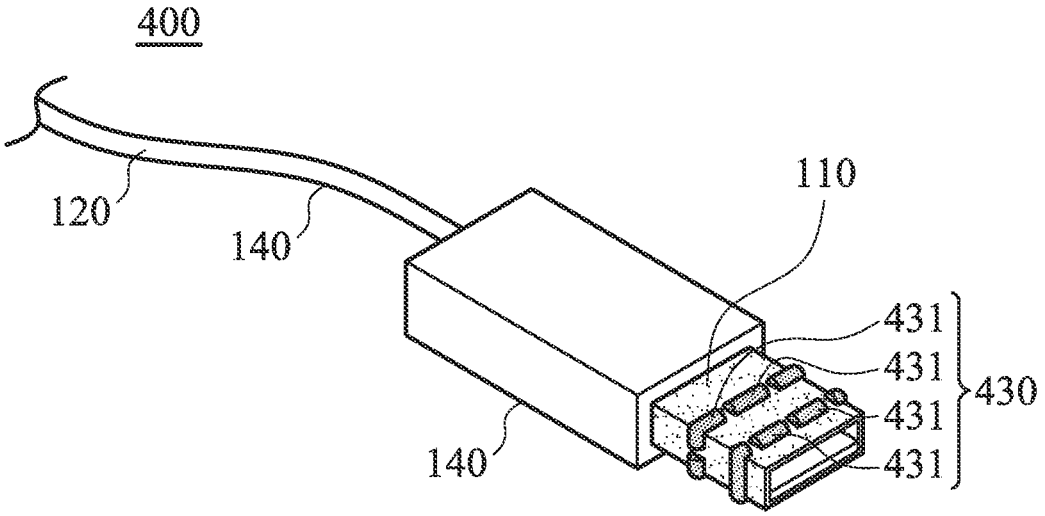
FIG. 4 is a perspective view of a high-speed-transmission connection device according to an embodiment of the invention.

FIG. 4 is a perspective view of a high-speed-transmission connection device 400 according to an embodiment of the invention. FIG. 4 is similar to FIG. 1A. In the embodiment of FIG. 4, a metal protrusion structure 430 of the high-speed-transmission connection device 400 includes multiple protrusion portions 431. The protrusion portions 431 are separate from each other and interleaved with each other on the outer surface of the male connector 110. More specifically, the above separate protrusion portions 431 surround the outer surface of the male connector 110 as much as possible. In some embodiments, if the spacing between two adjacent protrusion portions 431 is a predetermined distance, each protrusion portion 431 should have a length which is greater than the predetermined distance (e.g., the length of each protrusion portion 431 is 1.2, 1.5, 2, or 3 times the predetermined distance), thereby reducing the electromagnetic wave leakage. Other features of the embodiment of FIG. 4 are similar to those of the embodiment of FIG. 1A. Accordingly, the two embodiments can achieve similar levels of performance.

Figure 5A:
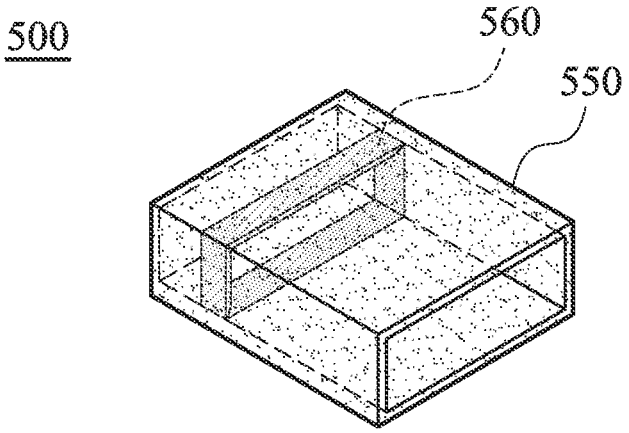
FIG. 5A is a perspective view of a high-speed-transmission connection device according to an embodiment of the invention.
Figure 5B:
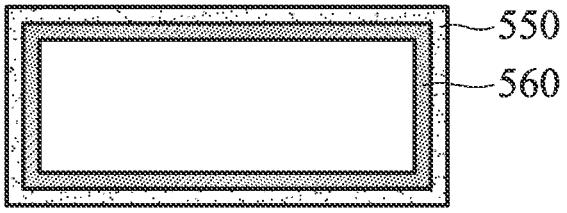
FIG. 5B is a sectional view of a high-speed-transmission connection device according to an embodiment of the invention.

FIG. 5A is a perspective view of a high-speed-transmission connection device 500 according to an embodiment of the invention. FIG. 5B is a sectional view of the high-speed-transmission connection device 500 according to an embodiment of the invention. Please refer to FIG. 5A and FIG. 5B together. The high-speed-transmission connection device 500 may be applied to a variety of high-speed-transmission interfaces, such as a USB (Universal Serial Bus) interface, an HDMI (High-Definition Multimedia Interface) interface, or a SATA (Serial Advanced Technology Attachment) interface, but the invention is not limited to the above.

As shown in FIG. 5A and FIG. 5B, the high-speed-transmission connection device 500 includes a female connector 550 and a metal protrusion structure 560. The female connector 550 may be made of a conductive material, such as a metal material. The shape and type of the female connector 550 are not limited in the invention. The metal protrusion structure 560 is formed on an inner surface of the female connector 550 (i.e., the metal protrusion structure 560 protrudes inwardly). The metal protrusion structure 560 may be substantially circularly-arc-shaped and have metal flexibility. In the embodiment of FIG. 5A and FIG. 5B, the metal protrusion structure 560 includes a loop portion, and the loop portion completely surrounds the inner surface of the female connector 550. In alternative embodiments, the metal protrusion structure 560 may have a different shape, such as a cubical shape or a triangular prism shape. In alternative embodiments, the metal protrusion structure 560 may be formed on only a portion of the female connector 550 (e.g., one side of the inner surface of the female connector 550), and may not surround the entire inner surface of the female connector 550. The usage of the metal protrusion structure 560 will be described in detail in the following embodiments.

Figure 6A:
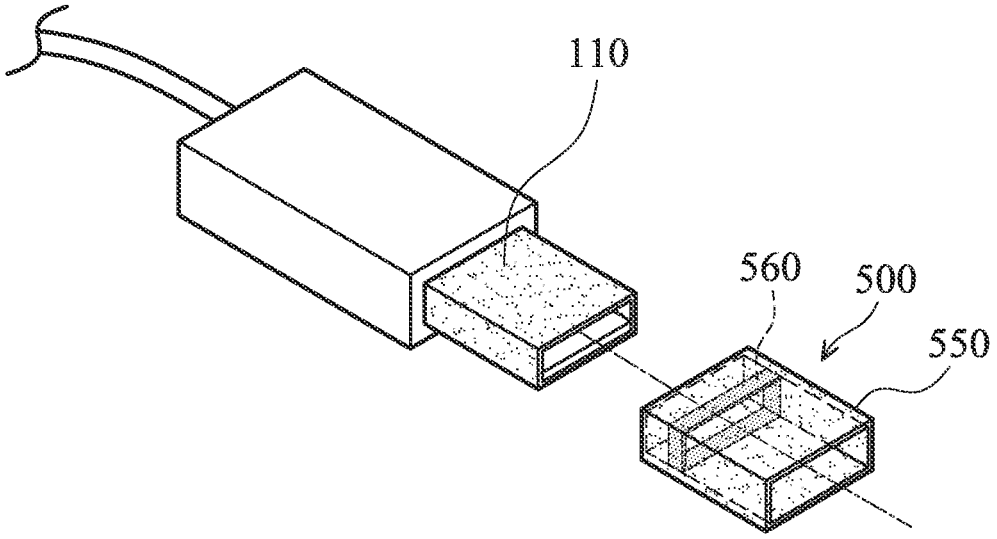
FIG. 6A is a perspective view of a high-speed-transmission connection device and a male connector according to an embodiment of the invention.
Figure 6B:
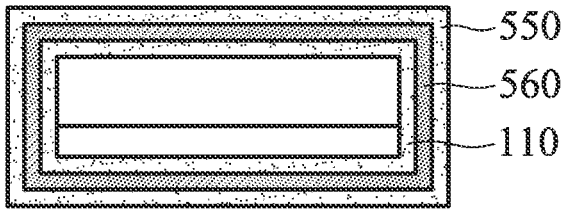
FIG. 6B is a sectional view of a high-speed-transmission connection device and a male connector according to an embodiment of the invention.

FIG. 6A is a perspective view of the high-speed-transmission connection device 500 and a male connector 110 according to an embodiment of the invention. FIG. 6B is a sectional view of the high-speed-transmission connection device 500 and the male connector 110 according to an embodiment of the invention. Please refer to FIG. 6A and FIG. 6B together. It should be understood that the male connector 110 may be any general connector corresponding to the female connector 550. For example, if the female connector 550 is a USB female connector, the male connector 110 may be a USB male connector. When the female connector 550 of the high-speed-transmission connection device 500 is connected to the male connector 110, the metal protrusion structure 560, formed on the inner surface of the female connector 550, is in close contact with the outer surface of the male connector 110. More specifically, since the metal protrusion structure 560 has metal flexibility, it may be slightly compressed and tend to engage with the outer surface of the male connector 110. The metal protrusion structure 560 can fill a gap between the male connector 110 and the female connector 550, and prevent electromagnetic waves from leaking outwardly from the gap. With the design of the invention, even if there are high-frequency signals delivered in transmission interfaces, the induced electromagnetic waves cannot radiate outwardly from the gap between the male connector 110 and the female connector 550, thereby effectively reducing the EMI (Electromagnetic Interference) in devices.

Figure 7:
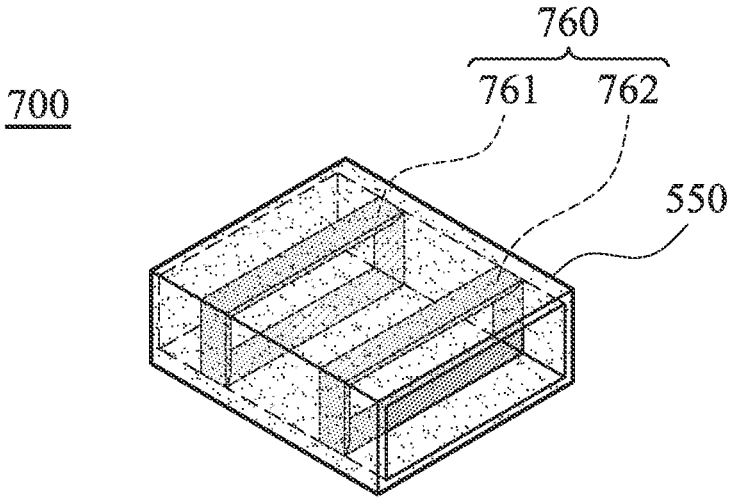
FIG. 7 is a perspective view of a high-speed-transmission connection device according to an embodiment of the invention.

FIG. 7 is a perspective view of a high-speed-transmission connection device 700 according to an embodiment of the invention. FIG. 7 is similar to FIG. 5A. In the embodiment of FIG. 7, a metal protrusion structure 760 of the high-speed-transmission connection device 700 includes a first loop portion 761 and a second loop portion 762. The first loop portion 761 is separate from and substantially parallel to the second loop portion 762. Both the first loop portion 761 and the second loop portion 762 surround the inner surface of the female connector 550. In alternative embodiments, the metal protrusion structure 760 may include three, four, five, or more separate and parallel loop portions. With such a design of multi-protrusion structure, the high-speed-transmission connection device 700 can further reduce the electromagnetic wave leakage and EMI. Other features of the embodiment of FIG. 7 are similar to those of the embodiment of FIG. 5A. Accordingly, the two embodiments can achieve similar levels of performance.

Figure 8:
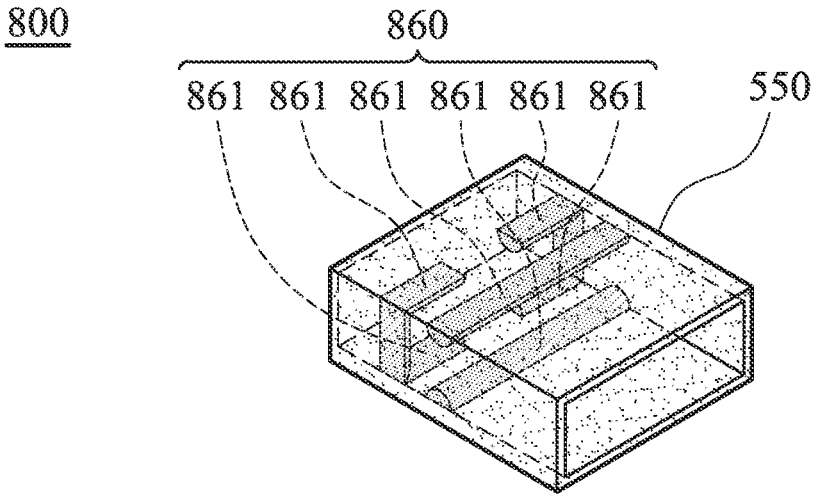
FIG. 8 is a perspective view of a high-speed-transmission connection device according to an embodiment of the invention.

FIG. 8 is a perspective view of a high-speed-transmission connection device 800 according to an embodiment of the invention. FIG. 8 is similar to FIG. 5A. In the embodiment of FIG. 8, a metal protrusion structure 860 of the high-speed-transmission connection device 800 includes multiple protrusion portions 861. The protrusion portions 861 are separate from each other and interleaved with each other on the inner surface of the female connector 550. More specifically, the above separate protrusion portions 861 surround the inner surface of the female connector 550 as much as possible. In some embodiments, if the spacing between two adjacent protrusion portions 861 is a predetermined distance, each protrusion portion 861 should have a length which is greater than the predetermined distance (e.g., the length of each protrusion portion 861 is 1.2, 1.5, 2, or 3 times the predetermined distance), thereby reducing the electromagnetic wave leakage. Other features of the embodiment of FIG. 8 are similar to those of the embodiment of FIG. 5A. Accordingly, the two embodiments can achieve similar levels of performance.

Figure 9A:
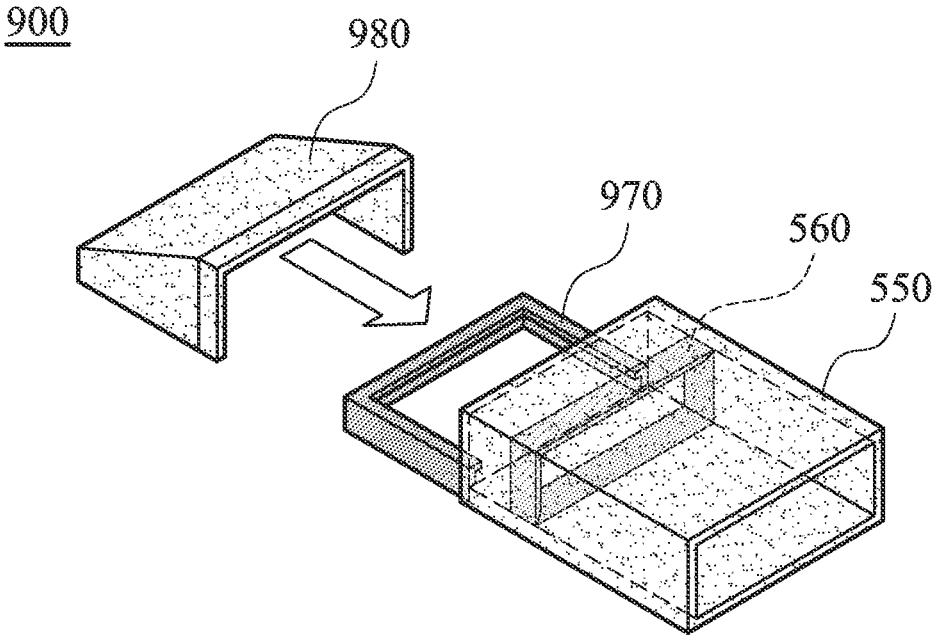
FIG. 9A is a perspective view of a high-speed-transmission connection device according to an embodiment of the invention.
Figure 9B:
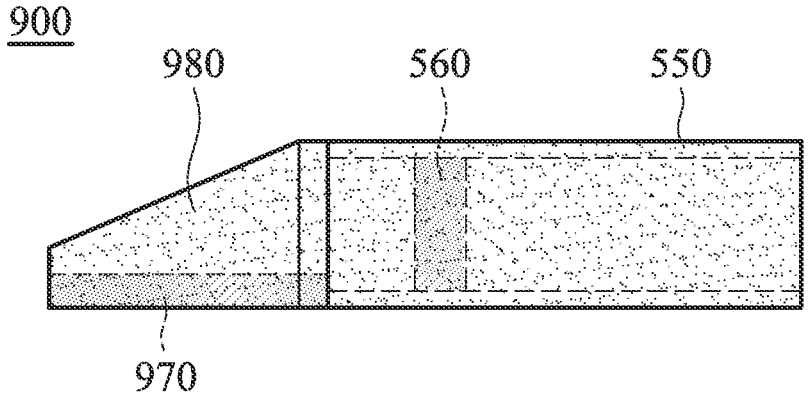
FIG. 9B is a side view of a metal back cover which has been engaged to a metal fastening element, according to an embodiment of the invention.

FIG. 9A is a perspective view of a high-speed-transmission connection device 900 according to an embodiment of the invention. FIG. 9A is similar to FIG. 5A. In the embodiment of FIG. 9A, the high-speed-transmission connection device 900 further includes a metal fastening element 970 and a metal back cover 980. The metal fastening element 970 is connected to a back side of the female connector 550. More specifically, the metal fastening element 970 is substantially inverted-U-shaped, and its two ends are respectively connected to the female connector 550. In some embodiments, the metal fastening element 970 is soldered to the female connector 550 through an SMT (Surface Mount Technology) process. The metal back cover 980 is engaged to the metal fastening element 970 (e.g., the metal back cover 980 may be engaged by a human operator) after the SMT process has been performed completely. FIG. 9B is a side view of the metal back cover 980 which has been engaged to the metal fastening element 970, according to an embodiment of the invention. As shown in FIG. 9B, the engaged metal back cover 980 can prevent electromagnetic waves from leaking outwardly from the back side of the female connector 550, thereby improving the EMI. It should be noted that, if the metal back cover 980 were directly soldered to the female connector 550 through the SMT process, the hot flow of the SMT process could not pass the metal back cover 980, such that the soldered portion is not successful. Accordingly, in the embodiment of FIG. 9A and FIG. 9B, a two-element design is adopted, in which the metal fastening element 970 is combined with the metal back cover 980. The proposed two elements are engaged to each other after the SMT process has been completed, and it can effectively overcome the drawback of the conventional one-element design. Other features of the embodiment of FIG. 9A and FIG. 9B are similar to those of the embodiment of FIG. 5A and FIG. 5B. Accordingly, the two embodiments can achieve similar levels of performance.

In some embodiments, in addition to one end of the cable connected to the male or female connector, another end of the cable may have the aforementioned metal protrusion structure of FIG. 1A to 9B, so as to reduce the electromagnetic wave leakage interference from the computer base and enhance the effect of the invention.

According the measurement, when the proposed high-speed-transmission connection device or plug of the invention is used, the noise floor of the relative equipment may be reduced by about 10 dB. Nowadays, for the standard of high-frequency and high-speed-transmission interfaces (e.g., the USB 3.0 standard), the invention provides a low-cost, high efficiency solution for solving the problem of antennas experiencing interference from radio-frequency radiation.

It should be noted that the above element sizes, element shapes, and element parameters are not limitations of the invention. A designer can adjust these setting values according to different requirements. The high-speed-transmission connection device of the invention is not limited to the configurations of FIGS. 1A to 9B. The invention may merely include any one or more features of any one or more embodiments of FIGS. 1A to 9B. In other words, not all of the features shown in the figures should be implemented in the high-speed-transmission connection device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A high-speed-transmission connection device for use in a wireless communication device with an antenna, comprising:

a male connector which is made of a metal material;

a cable, connected to the male connector; and a metal protrusion structure, formed on an outer surface of the male connector and electrically connected to the male connector for reducing electromagnetic wave leakage from the high-speed-transmission connection device to the antenna;

wherein the metal protrusion structure is protruded outwardly relative to the outer surface of the male connector.

2. The high-speed-transmission connection device as claimed in claim 1, further comprising:

a cladding layer, covering the male connector and the cable, wherein the cladding layer is made of a nonconductive material.

3. The high-speed-transmission connection device as claimed in claim 1, wherein the metal protrusion structure is substantially circularly-arc-shaped.

4. The high-speed-transmission connection device as claimed in claim 1, wherein when the male connector is connected to a female connector, the metal protrusion structure is in close contact with an inner surface of the female connector.

5. The high-speed-transmission connection device as claimed in claim 4, wherein the metal protrusion structure fills a gap between the male connector and the female connector, and prevents electromagnetic waves from leaking outwardly from the gap.

6. The high-speed-transmission connection device as claimed in claim 1, wherein the metal protrusion structure comprises a loop portion, and the loop portion surrounds the outer surface of the male connector.

7. The high-speed-transmission connection device as claimed in claim 1, wherein the metal protrusion structure comprises a first loop portion and a second loop portion, the first loop portion is separate from the second loop portion, and both the first loop portion and the second loop portion surround the outer surface of the male connector.

8. The high-speed-transmission connection device as claimed in claim 1, wherein the metal protrusion structure comprises a plurality of protrusion portions, and the protrusion portions are separate from each other and interleaved with each other on the outer surface of the male connector.

9. The high-speed-transmission connection device as claimed in claim 1, wherein the high-speed-transmission connection device is applied to a USB (Universal Serial Bus) interface, an HDMI (High-Definition Multimedia Interface) interface, or a SATA (Serial Advanced Technology Attachment) interface.

10. A high-speed-transmission connection device for use in a wireless communication device with an antenna, comprising:

a female connector which is made of a metal material; and a metal protrusion structure, formed on an inner surface of the female connector and electrically connected to the female connector for reducing electromagnetic wave leakage from the high-speed-transmission connection device to the antenna;

wherein the metal protrusion structure is protruded inwardly relative to the inner surface of the female connector.

11. The high-speed-transmission connection device as claimed in claim 10, wherein the metal protrusion structure is substantially circularly-arc-shaped.

12. The high-speed-transmission connection device as claimed in claim 10, wherein when the female connector is connected to a male connector, the metal protrusion structure is in close contact with an outer surface of the male connector.

13. The high-speed-transmission connection device as claimed in claim 12, wherein the metal protrusion structure fills a gap between the male connector and the female connector, and prevents electromagnetic waves from leaking outwardly from the gap.

14. The high-speed-transmission connection device as claimed in claim 10, wherein the metal protrusion structure comprises a loop portion, and the loop portion surrounds the inner surface of the female connector.

15. The high-speed-transmission connection device as claimed in claim 10, wherein the metal protrusion structure comprises a first loop portion and a second loop portion, the first loop portion is separate from the second loop portion, and both the first loop portion and the second loop portion surround the inner surface of the female connector.

16. The high-speed-transmission connection device as claimed in claim 10, wherein the metal protrusion structure comprises a plurality of protrusion portions, and the protrusion portions are separate from each other and interleaved with each other on the inner surface of the female connector.

17. The high-speed-transmission connection device as claimed in claim 10, wherein the high-speed-transmission connection device is applied to a USB (Universal Serial Bus) interface, an HDMI (High-Definition Multimedia Interface) interface, or a SATA (Serial Advanced Technology Attachment) interface.

18. The high-speed-transmission connection device as claimed in claim 10, further comprising:

a metal fastening element, connected to a back side of the female connector, wherein the metal fastening element is substantially inverted-U-shaped.

19. The high-speed-transmission connection device as claimed in claim 18, wherein the metal fastening element is soldered to the female connector through an SMT (Surface Mount Technology) process.

20. The high-speed-transmission connection device as claimed in claim 19, further comprising:

a metal back cover, wherein the metal back cover is engaged to the metal fastening element after the SMT process has been performed completely.

* * * * *